US005171969A

United States Patent [19]

Nishimura et al.

[11] Patent Number: 5,171,969

[45] Date of Patent: Dec. 15, 1992

[54] MOVABLE FILM FIXING DEVICE WITH HEATER CONTROL RESPONSIVE TO SELECTED SHEET SIZE

[75] Inventors: Matsuomi Nishimura, Ohmiya; Shinji Hanada; Takayuki Ishihara, both of Yokohama; Kazuki Tanaka, Yokohama; Hisaaki Senba, Yokohama; Koji Masuda, Yokohama, all of Japan

[73] Assignee: Canon Kabushiki Kaisha, Tokyo, Japan

[21] Appl. No.: 603,223

[22] Filed: Oct. 25, 1990

[30] Foreign Application Priority Data

| | | | |
|---|---|---|---|
| Oct. 30, 1989 | [JP] | Japan | 1-282574 |
| Dec. 22, 1989 | [JP] | Japan | 1-333045 |
| Oct. 5, 1990 | [JP] | Japan | 2-267643 |

[51] Int. Cl.[5] ..... G03G 15/20

[52] U.S. Cl. ..... 219/216; 355/282; 355/285; 355/290

[58] Field of Search ..... 355/282, 285, 289, 290, 355/295, 311, 210; 219/216, 541, 543; 346/76 PH; 432/59, 60

[56] References Cited

U.S. PATENT DOCUMENTS

| | | | |
|---|---|---|---|
| 1,093,968 | 4/1914 | Bicknell | 219/543 X |
| 3,810,735 | 5/1974 | Moser | 219/216 X |
| 3,832,524 | 8/1974 | Takiguchi | 219/216 |
| 4,075,455 | 2/1978 | Kitamura et al. | 219/216 |
| 4,566,779 | 1/1986 | Coli et al. | 355/212 |
| 4,774,397 | 9/1988 | Grise | 219/549 |
| 4,801,968 | 1/1989 | Kogure et al. | 355/291 |
| 4,883,941 | 11/1989 | Martin et al. | 219/216 |
| 4,954,845 | 9/1990 | Yano et al. | 355/290 |
| 4,998,121 | 3/1991 | Koh et al. | 355/285 X |
| 5,026,276 | 6/1991 | Hirabayashi et al. | 219/216 X |
| 5,027,160 | 6/1991 | Okada et al. | 355/282 |
| 5,043,763 | 8/1991 | Koh et al. | 355/206 |

FOREIGN PATENT DOCUMENTS

| | | | |
|---|---|---|---|
| 295901 | 12/1988 | European Pat. Off. . | |
| 59-197067 | 11/1984 | Japan . | |
| 0104348 | 6/1985 | Japan | 346/76 PH |
| 0084260 | 4/1986 | Japan | 346/76 PH |
| 0137759 | 6/1986 | Japan | 346/76 PH |
| 0313182 | 12/1988 | Japan | 355/210 |

*Primary Examiner*—A. T. Grimley
*Assistant Examiner*—J. E. Barlow, Jr.
*Attorney, Agent, or Firm*—Fitzpatrick, Cella, Harper & Scinto

[57] ABSTRACT

An image fixing apparatus includes a heater; a film movable in contact with the heater at one side thereof and in contact with a recording material at the other side thereof, wherein a visualized image on the recording material is heated and fixed by heat from the heater through the film; the heater including a heat generating layer extending in a direction crossing a movement direction of the film, for producing the heat by the application of a voltage between its longitudinal opposite ends; an electric path branched out of an image fixing part of the heat generating layer; and a selector for selecting the electric path in accordance with a size of the recording material.

35 Claims, 10 Drawing Sheets

MOVABLE FILM FIXING DEVICE WITH HEATER CONTROL RESPONSIVE TO SELECTED SHEET SIZE

FIELD OF THE INVENTION AND RELATED ART

The present invention relates to an image fixing apparatus for sheet-fixing a visualized image on a recording material through a film.

In a widely used conventional image fixing apparatus wherein the toner image is fixed on the recording material supporting an unfixed toner image, the recording material is passed through a nip formed between a heating roller maintained at a predetermined temperature and a pressing or back-up roller having an elastic layer and press-contacted to the heating roller.

However, the heat-roller type fixing system involves a problem that a long warming period is required until the surface of the heating roller reaches a predetermined set temperature.

U.S. patent applications, 07 series, Ser. Nos. 206,767; 416,539; 435,247; 440,678; 444,802; 813,912 (which is a Continuation-in-Part of Ser. No. 496,957); and 502,223 and U.S. Pat. Nos. 4,998,121; 4,954,845; 5,043,763; 5,026,276; and 5,027,160 have proposed an image fixing apparatus using a heat generating resistor layer and a thin film to significantly reduce or eliminate the warming period.

Such an image fixing apparatus has an electrically energizable heat generating layer extending in a direction perpendicular to the movement direction of the recording material. By applying electric voltage between longitudinal opposite ends of the heat generating layer, each longitudinal part of the effective length of the heat generating layer produces a predetermined heat per unit area. The effective length of the heat generating layer is so determined that the image fixing apparatus can accept the width (maximum width of the maximum size) of the recording material having the maximum size usable with the image forming apparatus into which the fixing apparatus is incorporated.

During the fixing operation, the entire effective length of the heat generating layer is energized irrespective of the size of the recording material used, and each part of the heat generating layer produces predetermined heat per unit area. By doing so, the image fixing operation is possible for the surface of the recording material supplied, irrespective of various sizes of the recording materials if the width is smaller than the usable maximum width.

It is noted, however, that when the width of the recording material used is smaller than the maximum width of the part of the heat generating layer corresponding to the difference between the maximum width and the width of the used sheet, that is, the part where the recording material does not exist (non-passage part), is also energized at the same rate as in the passage part. The thermal energy by the heat generating layer corresponding to the sheet passage part is consumed for fixing the image, but the thermal energy at the non-passage part is not consumed for the image fixing, operation and therefore, is accumulated.

Thus, non-passage part of the heater tends to be overheated, so that there arise the durable service life is reduced because of the thermal damage of the heater or the heat generating layer, the reduction of durability of the fixing film or the pressing member is reduced and/or the instability in the travel of the fixing film (inclined travel or production of crease or the like).

These tendencies become more remarkable with an increase of the maximum recording medium width. In order to avoid these problems, U.S. Ser. No. 440,380 has proposed that the heat generating layer is divided into plural longitudinal sections, which are selectively energized in accordance with the size of the recording material.

However, it has been found that temperature non-uniformity tends to be significant if the heat generating layer is completely divided.

SUMMARY OF THE INVENTION

Accordingly, it is a principal object of the present invention to provide an image fixing apparatus wherein the temperature rise in the non-passage part is effectively prevented.

It is another object of the present invention to provide an image fixing apparatus wherein the temperature difference between the passage part and the non-passage part is reduced.

It is a further object of the present invention to provide an image fixing apparatus wherein the amount of heat generated at the non-passage part is reduced by dividing the electric current at the non-passage part.

It is a yet further object of the present invention to provide an image fixing apparatus wherein the heat generating layer has a branched or forked structure.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
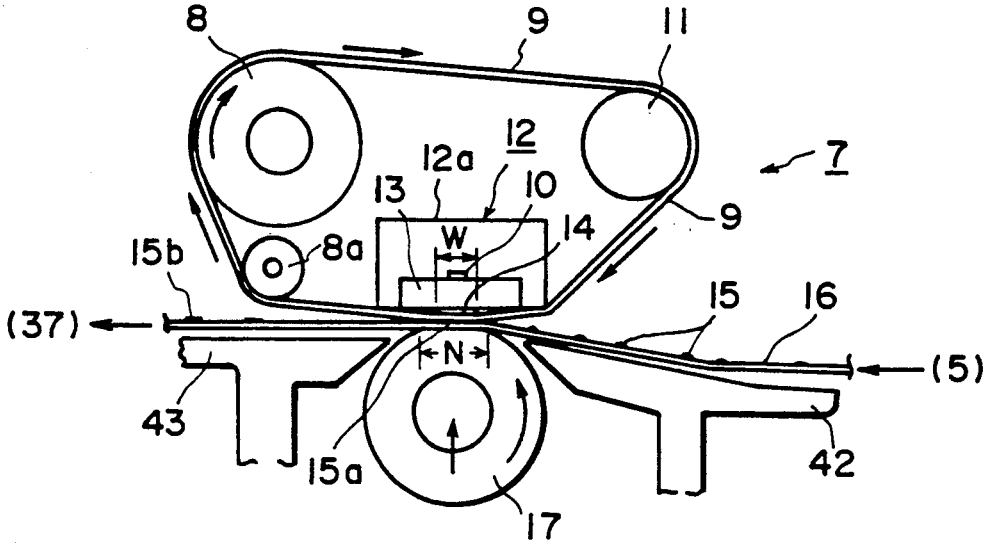
FIG. 1 is a sectional view of an image fixing apparatus according to an embodiment of the present invention.

The preferred embodiments will be described in conjunction with the accompanying drawings wherein like reference numerals are assigned to the elements having the corresponding functions.

Figure 3:
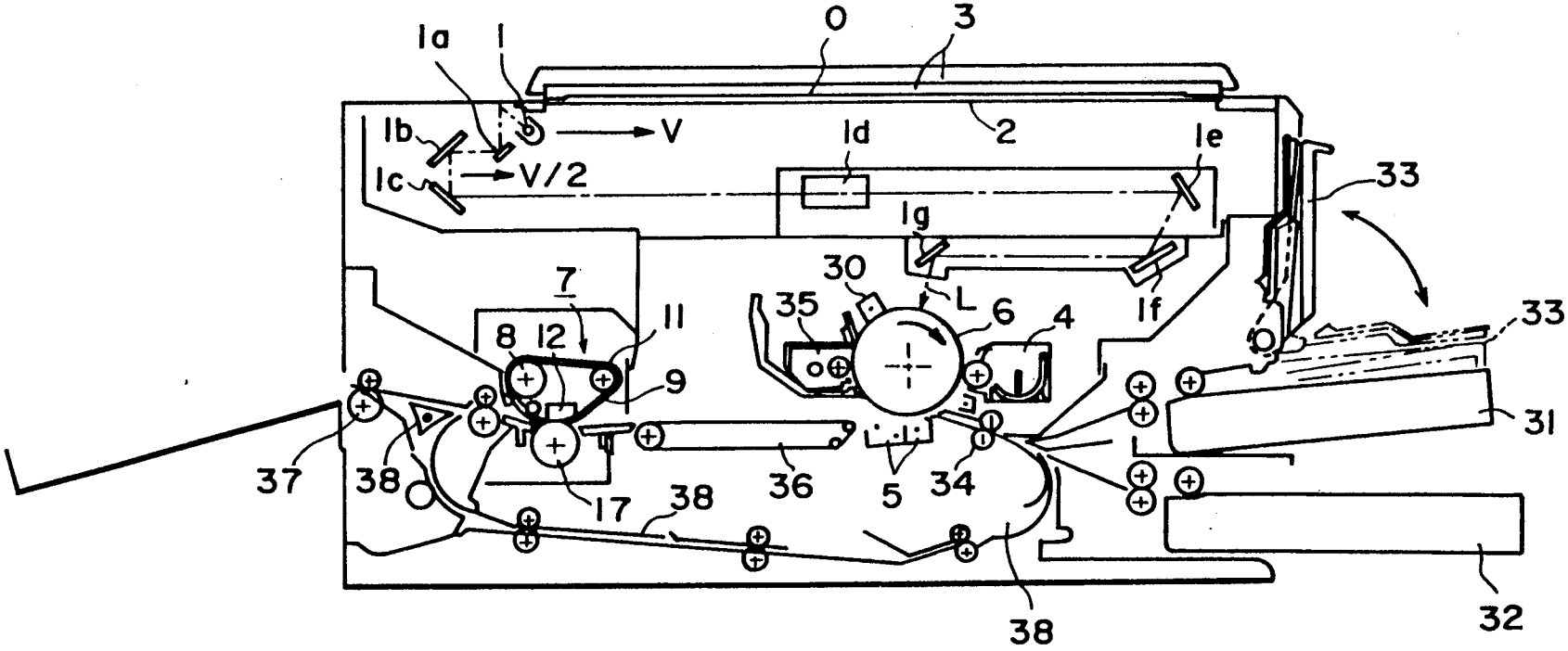
FIG. 3 is a sectional view of an image forming apparatus incorporating the image fixing apparatus of FIG. 1 embodiment.

Referring to FIG. 3, there is shown an image forming apparatus using an image fixing apparatus according to an embodiment of the present invention. The image forming apparatus shown is an image transfer type electrophotographic copying apparatus wherein an original supporting platen is stationary, and an optical system is movable, which uses a rotatable drum type photosensitive member, and which is capable of forming duplicate copies and superposing copies. Since the process and mechanism for the image formation of the copying apparatus are known a description thereof will be made only briefly.

An original 0 to be copied is placed face down on a fixed original supporting platen glass at a predetermined reference position, and is covered by an original cover 3. Upon copy start signal, a photosensitive member 6 in the form of a rotatable drum is rotated at a predetermined peripheral speed (process speed) in a direction indicated by an arrow (clockwise direction), and is uniformly charged to a predetermined potential by a charger 30. A movable illuminating lamp 1 and a movable first mirror 1*a* of an imaging optical system is moved forwardly from the left side to the right side of the original supporting glass 2 at a predetermined speed V, and a second movable mirror 1*b* and a third movable mirror 1*c* are moved in the same direction but at a speed of V/2. By this, the faced down image surface of the original 0 is sequentially optically scanned from the left side to the right side, and the image of the scanned original is focused and projected on the surface of the rotating photosensitive member 6 having been charged by the charger, through an imaging lens 1*d*, a fixed fourth mirror 1*e*, a fixed fifth mirror 1*f* and a fixed sixth mirror 1*g*. Then, an electrostatic latent image is formed on the surface of the photosensitive member 6 in accordance with the image of the original.

The latent image is sequentially visualized with powdery toner (developer) made of a heat-softening or heat-fusible resin or similar material by a developing device 4. The visualized toner image is transferred onto the recording material (transfer sheet). The transfer material is fed one-by-one into the apparatus from a first sheet cassette 31, a second sheet cassette 32 or a manual feeding means 33. The transfer material is then fed to a transfer station formed between the photosensitive member 6 and the transfer/separating charger means 5 at a predetermined timing, by a couple of registration rollers 34. Then, the visualized image is sequentially transferred onto the transfer material.

The transfer material sheet having received the image is introduced into the fixing apparatus 7 by a sheet conveyor 36. In the fixing apparatus, the image is fixed on the transfer sheet, and the sheet is discharged by the sheet discharging roller 37 to the outside of the apparatus as a print (copy), in the case the apparatus operates in a simplex copy mode.

In case the apparatus operates in a duplex or superposing copy mode, the transfer sheet, having been discharged from the fixing apparatus 7 and having a first image or an image on one side, is introduced into the apparatus again along a re-feeding sheet passage mechanism 38, to the transfer station 5 with or without inversion of the faces of the sheet, and the sheet is subjected to the image transfer operation on the other side or on the same side.

After the image transfer operation, the photosensitive member 6 is cleaned by a cleaning device 35, so that the surface thereof is cleaned, and the photosensitive member 6 is prepared for repeated image formation.

Referring to FIG. 1, there is shown an enlarged sectional view of the fixing apparatus 7 according to the embodiment of the present invention. It comprises a fixing film 9 in the form of an endless belt which is stretched around parallel four members, namely, a left side driving roller 8, a right side follower roller 11, a low thermal capacity linear heater 12 fixedly supported below a position between the rollers 8 and 11, and a guiding roller 8*a* disposed below the driving roller 8.

The follower roller 11 functions also as a tension roller for the fixing film 9. The fixing film is rotated by the clockwise rotation of the driving roller 8 in a clockwise direction at a predetermined peripheral speed without snaking and cressing.

A pressing roller 17 has a rubber elastic layer made of silicone rubber or similar material having a good parting property. It urges the bottom travel of the fixing film 9 in the form of an endless belt to the heater 12 toward the bottom surface of the heater 12 by an urging means with the total pressure of 4–7 kg. It rotates in the counterclockwise direction, that is, codirectional with the transfer sheet 16 conveyance direction.

The fixing film 9 in the form of the belt rotated is repeatedly used for the heating and fixing of the toner image, and therefore, it desirably has a heat resistivity, a parting property, and durability. Generally, the thickness thereof is not more than 100 microns, preferably not more than 50 microns. It may be a single layer film of a heat resistive resin such as polyimide, polyether imide, PES, PFA (tetrafluoroethylene perfluoroalkylvinylether copolymer resin), or a multi-layer film comprising, for example, a film having 20 microns thickness and a coated parting layer of 10 microns thickness, at an image contactable side, made of fluorinated resin such as PTFE (tetrafluoroethylene resin) or PFA, added by conductive material.

The heater (low thermal capacity linear heater) 12 in this embodiment comprises an elongated heater supporting member 12*a* extending in a direction crossing with the movement direction of the fixing film (the direction perpendicular to the travel of the fixing film 9) and having sufficient rigidity, heat durability and heat insulation property, and a heater board 13 (having a good thermal conductivity) integrally mounted on and along the bottom surface of the supporting member 12*a*.

The heater board 13, as will be described hereinafter, is provided with a heat generating layer 14 supplied with electric energy at the opposite ends thereof, a branch electric passages for limiting the effective heat generating regions in the longitudinal direction of the heat generating member 14 (heater 12), power supply electrodes and temperature sensor 10 or the like.

The heater support 12*a* is effective to assure the entire mechanical strength of the heater 12, and to increase the thermal efficiency by heat insulation at the back of the heat generating member 14. It is made of, for example, highly heat resistive resin such as PPS (polyphenylene sulfide), PIA (polyamide imide), PI (polyimide), PEEK (polyetheretherketone), liquid crystal polymer or the like or a compound material comprising such a resin and ceramic material, metal, glass or similar material.

The heater board 13 has a heat resistivity and electric insulation properties. For example, it is an alumina board having a thickness of 1.0 mm, a width of 10 mm and a length of 240 mm.

The heat generating layer 14 is a linear or stripe heat generating layer which has a low thermal capacity and which is energized with electric power. For example, it is in the form of an electric resistor material having a width of 1.0 mm printed (screen printing or the like) along the longitudinal direction substantially at the center of the bottom surface of the board 13, which is the sliding side relative to the film. The resistor material is, for example, $Ta_2N$, silver-palladium, or the like.

The temperature sensor 10 is disposed on the board 13 (having good thermal conductivity) on a side opposite from the side having the heat generating layer 14. In this embodiment, the temperature sensor 10 detects the temperature of the board 13 as the temperature of the heater 12.

Figure 4:
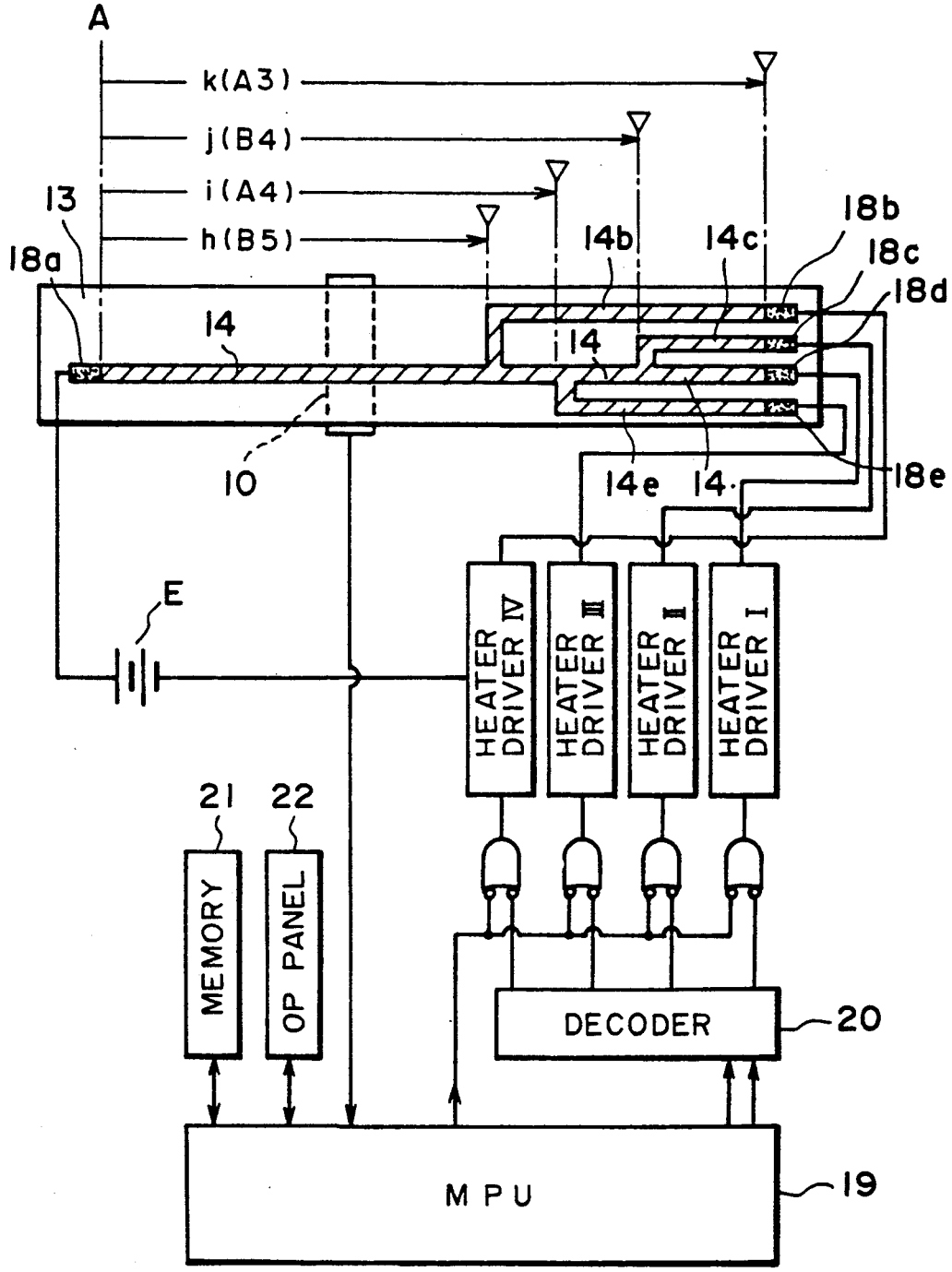
FIG. 4 is a block diagram of a heat controlling circuit.

In this embodiment, the linear or stripe heat generating layer 14 is connected with a voltage source at its opposite longitudinal ends to generate heat over the entire length. The power supply is, for example, in the form of pulse waves supplied from a DC power source. An electric power control circuit changes the width of the driving pulse in accordance with the set temperature and the energy emission in accordance with an output of the temperature sensor 10 and under the control of the microcomputer MPU 19 (FIG. 4).

In this embodiment, a sensor (not shown) is provided for sensing the leading and trailing edges of the sheet at a position close to the fixing apparatus and upstream of the fixing apparatus 7 with respect to the transfer sheet conveyance direction. In response to the detection signals of the sensor, the power supply period to the heat generating element 14 is limited to the necessary period in which the sheet 16 is present in the fixing apparatus 7.

Figure 2:
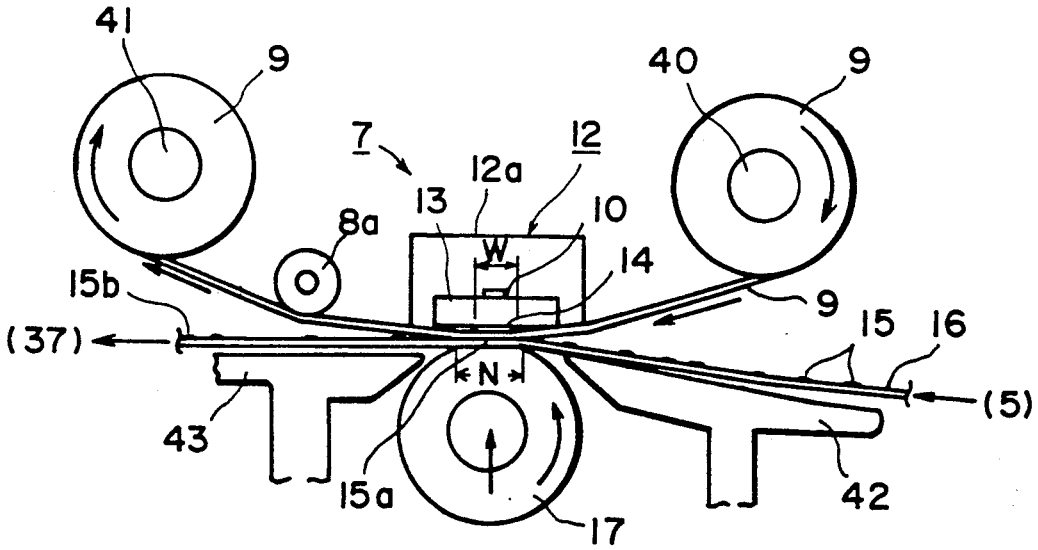
FIG. 2 is a sectional view of an image fixing apparatus according to another embodiment of the present invention.

The fixing film 9 is not limited to the endless belt form. Another alternative is shown in FIG. 2 wherein a non-endless fixing film 9 is wound on a supply shaft 40 in the form of a roll, and an end of the fixing film 9 is mounted on a take-up shaft 41 so that the fixing film 9 extends from the supply shaft 40 to the take-up shaft through between the heater 12 and the pressing roller 17 and below the guiding roller 8*a*. The fixing film 9 is fed from the supply shaft 40 to the take-up shaft 41 at a predetermined speed.

The operation of the fixing apparatus will be described. In response to an image formation start signal, the image forming apparatus is operated. The transfer sheet 16 is fed into the transfer station 5 and receives an unfixed toner image 15 on its top surface, and then is conveyed to the fixing apparatus 7. When the leading edge of the transfer sheet 16 is detected by the sensor (not shown) disposed adjacent to the fixing apparatus 7, the fixing film 9 starts to rotate or move. The transfer sheet 16 is guided by a guide 42 and is introduced into a fixing nip N formed between the heater 12 and the pressing roller 17, more particularly between the fixing film 9 and the pressing roller 17, where the transfer sheet is moved under pressure together with the moving fixing film 9 without surface deviation or cressing, while the unfixed toner image surface is in contact with the bottom surface of the fixing film 9.

The heat generating element 14 has a width W and is in the width of the fixing nip N between the bottom surface of the heater 12 and the top surface of the pressing roller 17.

During the passage of the sheet 16 through the fixing nip N, the toner image bearing surface of the sheet 16 is press-contacted to the fixing film, the toner image is heated by the heat of the heat generating element 14 through the fixing film, and the toner image is fused by the high temperature and softened and adheres to the sheet 16 surface, as shown by a reference 15*a*.

In the case of this embodiment, the separation between the sheet 16 (recording material) and the fixing film 9 is effected at a position where the sheet 16 has passed through the fixing nip N.

At the time of the separation, the temperature of the fused toner 15*a* is still higher than the glass transition point of the toner, and therefore, the bonding strength (adhering strength) between the sheet 16 and the fixing film 9 at the time of separation is still small, and therefore, the sheet 16 is separated from the fixing film 9 surface with hardly any toner offset to the fixing film 9 and without the sheet 16 being wrapped on the fixing film 9. Therefore, the separating action is smooth.

The toner 15*a* which has a temperature higher than the glass condition point has a proper rubber property, and therefore, the toner image surface, upon the separation, does not have the surface property of the fixing film, and therefore, has proper surface roughness. Since the toner image is cooled and solidified with the surface property maintained. Accordingly, the surface of the toner image is not too glossy, so that the quality of the image is maintained high.

The sheet 16 thus separated from the fixing film 9 is guided by a guide 43 to discharging rollers 37, and during this period, it is spontaneously cooled from a level higher than the glass transition point to a level not more than the glass transition point, so that it is solidified, as indicated by a reference 15*b*. A sheet 16 on which the image has been fixed is discharged.

In this embodiment, the effective heat generating region is changed in accordance with the size of the recording material in order to prevent a temperature rise at the non-passage part where the sheet does not pass through the nip N.

A description will be provided as to the control of the effective heat generating part. As shown in FIG. 4, on the film sliding side (bottom side) of the board 13 of the heater 12, there are a heat generating layer 14, and three branch electric paths, namely a first path 14*b*, a second path 14*e* and a third path 14*c*. The paths, in this embodiment, are made of the same material as the heat generating layer 14. The heat generating layer 14 extends straight along the length of the board 13 on the bottom surface thereof at substantially the center thereof. The left and right ends of the heat generating layer 14 are connected with power supply electrodes (input electrodes) made of good electric conductive material such as silver.

In this figure k denotes the maximum effective length of the heat generating layer 14 between the electrodes 18*a* and 18*d*. In this embodiment, it corresponds to the maximum size of the transfer sheet usable with the apparatus (A3).

In this embodiment, the transfer sheet is supplied with one lateral side (left side) of the transfer sheet having various sizes placed at a reference line A of the heat generating layer 14. The first path 14*b*, the second path 14*e* and the third path 14*c* are branched out of the heat generating layer 14 at positions which are distant from the reference line A by H, I and J, respectively. The right ends of the branch paths are extended to or beyond the right end of the heat generating layer 14.

The distances H, I and J correspond to the widths of B5, A4 and B4 sheets, respectively. The branch paths 14*b*, 14*e* and 14*c* are connected at their right ends with power supply electrodes (input electrodes) 18*b*, 18*e* and 18*c* made of good electric conductive material, such as silver or the a similar material.

The bottom surface of the heater provided with the heat generating layer 14, the branch paths 14*b*, 14*e* and 14*c* and power supply electrodes 18*a*, 18*d*, 18*b*, 18*e* and 18*c* which are slidable with the film 9. Therefore, it is preferable that the surface thereof are protected by provision of $Ta_2O_5$ or a similar material.

The temperature sensor 10 is mounted on the top surface of the board 13 which is on the opposite side from the side having the heat generating layer 14 or a similar layer and is disposed in the region corresponding to the minimum width region h.

Figure 5:
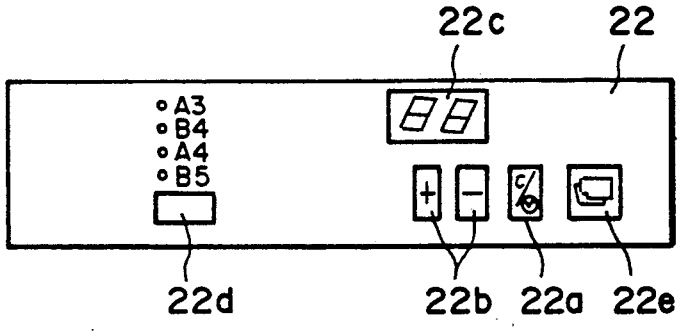
FIG. 5 is a top plan view of an operating panel of FIG. 3 apparatus.

Referring to FIG. 5, the operation panel of the image forming apparatus of FIG. 4 is shown as indicated by a reference numeral 22, and it comprises a power source switch 22*a*, copy number setting key 22*b*, number displaying device 22*c*, transfer material size setting key (size selector) 22*d*, a copy start button 22*e* or the like.

The information relating to the size selected by the size selector 22*d* is supplied to the microcomputer MPU 19. The microcomputer MPU 19 produces a decoding signal in accordance with the size selected to a decoder 12, and the decoded signal is used to selectively drive the heater driving circuit I, II, III and IV in accordance with the width of the selected size sheet. The circuits I-IV are connected with the electrodes 18*d*, 18*c*, 18*e* and 18*b*, respectively and are connected common to the left side common electrode 18*a* of the heat generating layer 14 through the power source E. Denoted by a reference numeral 21 is a memory circuit.

A description will be provided as to the power supply operation for the respective sizes of the transfer material.

When the maximum size A3 is selected, only the driving circuit I of the heater is driven, by which the voltage E is supplied only between the electrodes 18*a* and 18*d* of the heat generating layer 14, and the first, second and third branch paths 14*b*, 14*e* and 14*c* are not supplied with the voltage, and therefore, only the heat generating layer 14 is energized. Then, the entire effective region K of the heat generating layer 14 is energized to produce heat at a predetermined amount of heat per unit length, and the image fixing operation is carried out for the A3 sheet supplied into the apparatus.

When the B5 sheet is selected, the heater driving circuit I and the heater driving circuit IV are driven, by which the voltage E is applied between the electrode 18*a* and the electrode 18*d* and 18*b*. Therefore, the power supply circuit for the heat generating layer and the power supply circuit for the first passage 14*b* are closed.

Then, the part h of the heat generating layer corresponding to the width of the B5 sheet, that is, the part of the heat generating layer from the electrode 18*a* to the point of branch of the first path 14*b*, produces heat at the predetermined rate per unit length, so that the B5 sheet supplied into the apparatus is properly subjected to the image fixing operation.

On the other hand, the part of the heat generating layer corresponding to the non-passage part (k-h), that is, the portion of the heat generating layer at the branch point of the first branch path 14*b* to the electrode 18*d* cooperates with the first branch path 14*b* to form a parallel circuit. Therefore, the electric current is divided into two paths, and therefore, the amount of heat generation per unit length of the heat generating layer in this region is smaller than that of the sheet passing part h and in addition, the sum of the amount of generated by the heat generating layer and the amount of the heat generated by the first path 14*b* per unit length is also smaller than the amount of heat generated by the heat generating layer of the sheet passing part h.

Therefore, overheating of the heater corresponding to the portion of non-passage part (k-h) can be prevented.

When A4 sheet is selected as the transfer material sheet, the heater driver circuits I and III are energized, by which the power supply circuit for the heat generating layer 14 and the second branch path 14*e* is closed, and therefore, the portion of the heat generating layer corresponding to the passage part i of A4 sheet produces the heat at the predetermined sheet generating rate. Then, the image is properly fixed on the supplied A4 sheet. The heat generating layer and the second branch path 14*e* corresponding to the non-passage part (k-i) produce a total amount of heat which is smaller than the predetermined rate for the same reason as described above. Therefore, the heater portion corresponding to the non-passage part (k-i) is prevented from overheating.

When B4 sheet is selected as the transfer sheet, the heater driver circuits I and II a driven, by which the circuit for the heat generating layer 14 and the third branch path 14*c* are closed, and the part of the heat generating layer corresponding to the region i for the sheet passage part (B4 size) produces heat at the predetermined rate per unit length, and therefore, the B4 size sheet is properly subjected to the image fixing operation. The heat generating layer part corresponding to the non-passage part (k-i) and the third branch path 14*c*, produce a total heat which is smaller than the predetermined rate, and therefore, the overheating of the heater in the non-passage part (k-j) is prevented.

As described in this embodiment, the electric current path is branched, by which the heat generation rate per unit length in the sheet non-passage part than in the sheet passage part, and therefore, sheet non-passage part is prevented from overheating.

In this embodiment, the amount of heat generation in the heat-non-passage part is not zero. Therefore, the temperature difference between the sheet non-passage part and the sheet passage part is not too large, so that the production of the film crease and improper conveyance are prevented.

The electric resistances, width and thicknesses of the branch paths 14*b*, 14*e* and 14*c* can be properly determined by one skilled in the art if the above descriptions are considered. The materials can be properly selected by a skilled in the art, too. By a combination of them, the amount of heat generated by the heater in the non-passage part can be properly selected.

It is preferable that the temperature difference between the non-passage part and the passage part is sufficiently small, preferably not more than 10° C., even if the fixing operation is carried out continuously. The arrangement of the branch paths is not limited to the above-described combination, but another combination is selected properly by one skilled in the art.

Figure 6:
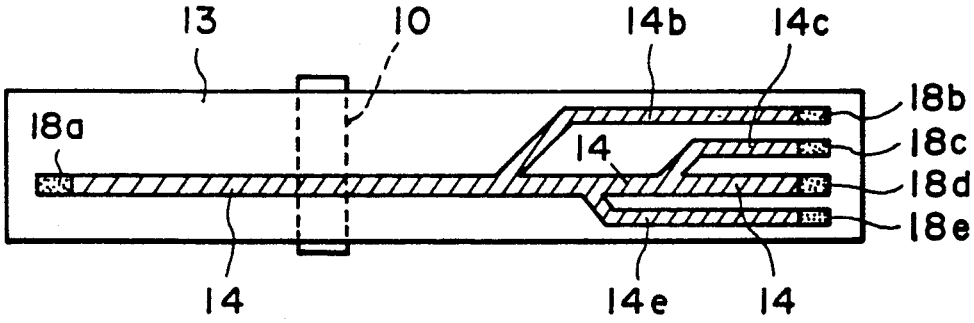
FIGS. 6–11, 12A, 12B, and 12C are top plan views of heaters used in other embodiments.

Referring to FIG. 6, a description will be provided as to another embodiment, wherein the branching paths of the branch paths 14*b*, 14*e* and 14*c* are inclined away from the sheet conveying reference A. By doing so, the non-uniformity of the total heat generating amount at the branch parts of the branch paths can be eliminated, so that the temperature is further made uniform in the longitudinal direction.

Figure 7:
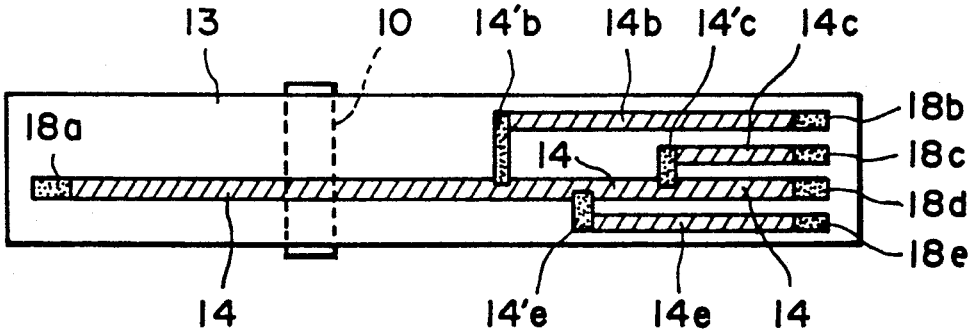

FIG. 7 shows a further embodiment wherein only the branching portions for the branch paths 14*b*, 14*e* and 14*c* only are made of good conductive material, as indicated by references 14'*b*, 14'*e* and 14'*c*. By doing so, the branch portions hardly produce heat, and therefore, the non-uniformity at the branch portions can be avoided.

Figure 8:
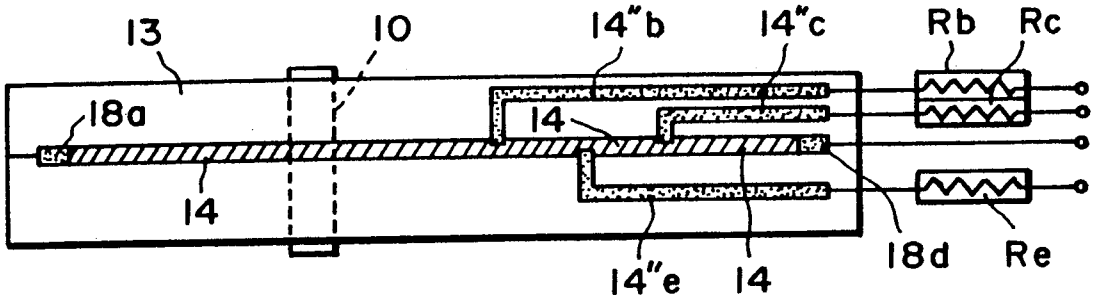

FIG. 8 shows a further embodiment, wherein all of the branch paths are made of good conductive material, as indicated by references 14''*b*, 14''*e* and 14''*c*, and they are connected with external resistors Rb, Re and Rc, respectively. By properly selecting the resistances of the external resistors, the amount of heat generation at the non-passage part of the heat generating layer 14 can be reduced, so that the overheating of the heater in the non-passage part can be avoided.

In the foregoing embodiments, the recording material is fed with its one lateral side aligned with a reference.

Figure 9:
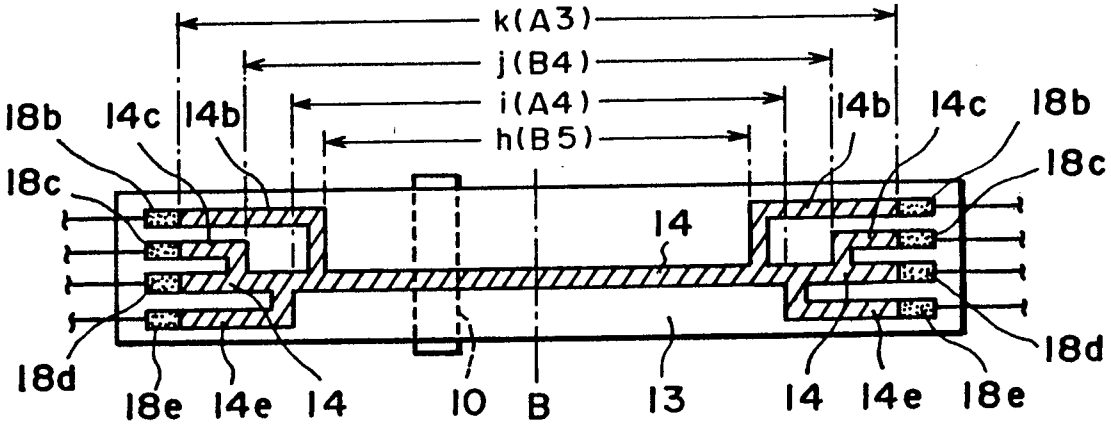
Figure 10:
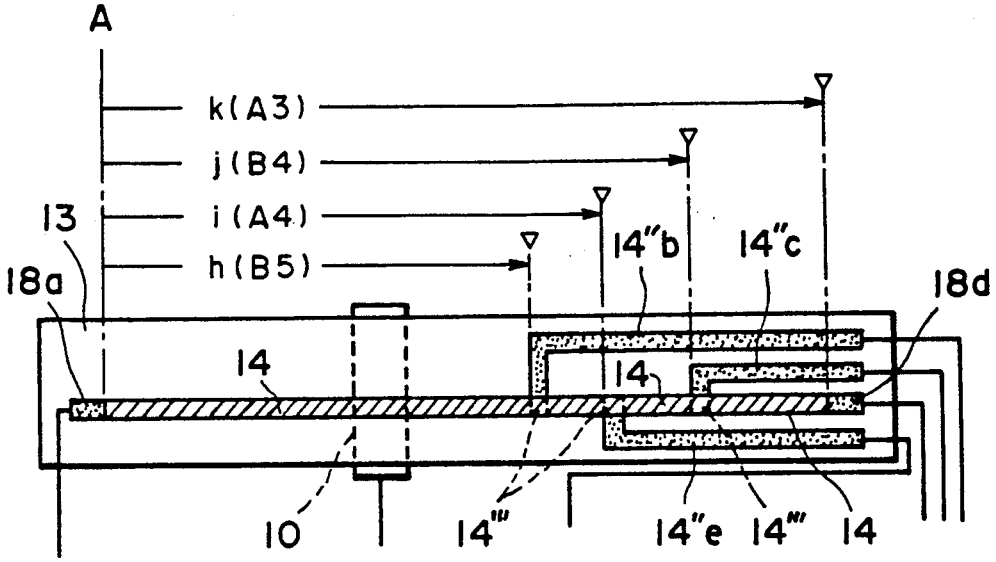

Referring to FIG. 9, a description will be provided as to a further embodiment wherein the recording material is fed with its center aligned with a central reference. As will be understood from FIG. 9, the heat generating layer 14 is branched toward both of the opposite outside ends in a symmetric fashion with respect to the conveyance reference B. Referring to FIG. 10, a further embodiment will be described. In this figure, first-third branch paths 14''*b*, 14''*e* and 14''*c* are made of good conductive material such as silver. The width of each of the paths is preferably as small as possible. In this embodiment, it is 1 mm.

When the size of the recording material is A3, a voltage is applied between the electrodes 18*a* and 18*d*. In the case of B4 size sheet, the voltage is applied between the electrodes 18*a* and 14''*c*; for A4 size, the voltage is applied between the electrodes 18*a* and 14''*e*; and for B5 size, the voltage is applied between the electrodes 18*a* and 14''*b*. As will be understood, the temperature rise is substantially completely prevented at the non-passage part. However, because the temperature difference between the sheet passage part and the non-passage part is increased in this embodiment, it is preferably used in an image fixing apparatus wherein the fixing temperature is relatively low.

Figure 11:
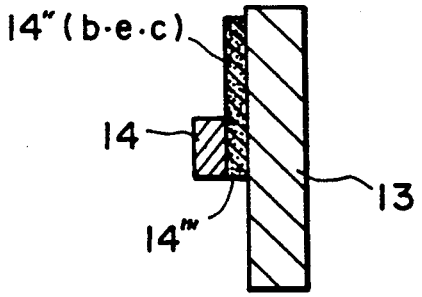

The manufacturing of the heat generating layer 14 and the branch paths 14''*b*, 14''*e* and 14''*c* will be described. First, the branch paths are formed on the surface of the alumina substrate 13. Then, the heat generating layer 14 is formed thereon. As shown in FIG. 11 which is an enlarged view, an end 14''' of the branch part is sandwiched by the substrate 13 and the heat generating layer 14 and is electrically connected with the heat generating layer 14 thereby.

By sandwiching the end 14''' of the branch path between the alumina substrate 13 and the heat generating layer 14 in the form of a laminated structure of the branch path and the heat generating layer, the heat escape possible at the overlying portion (of the heat generating layer and the branch path) can be suppressed. Therefore, the overheating in the non-passage part can be suppressed, and simultaneously, a local temperature decrease in the overlying part can be suppressed. Therefore, when a recording material having a size larger than the minimum size, for example, a maximum size recording material is heated, the local temperature decrease in the overlying can be prevented, and therefore, uniform heating is possible in the sheet passage part.

Figure 12A:
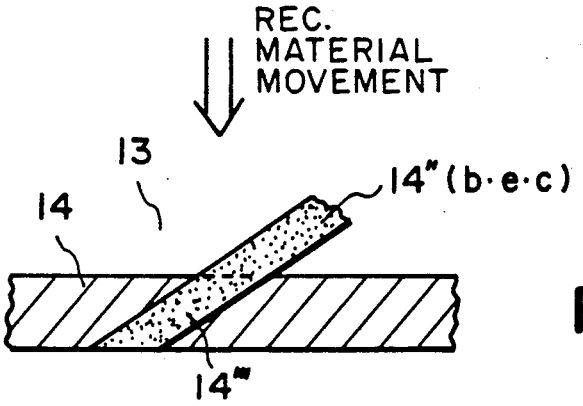
Figure 12B:
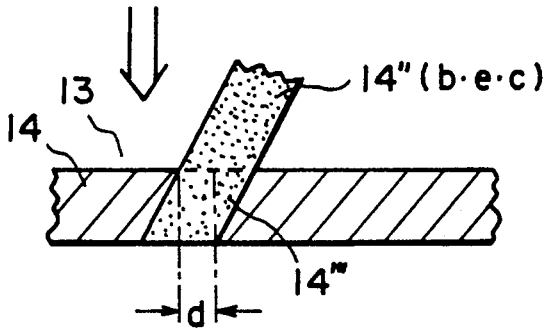

By inclined the branching part, the temperature decrease can be suppressed. In this case, it is preferable that at least a part of the heat generating layer is exposed in the branch connection for the branch path electrode, with respect to the sheet conveyance direction. In the case of 12*b*, the portion d is completely covered by the branch electrode, with the result that the temperature decrease prevention effect is not good. In the case of FIG. 12A, the portion d does not exist, and therefore, the temperature decrease prevention effect is very high.

Figure 12C:
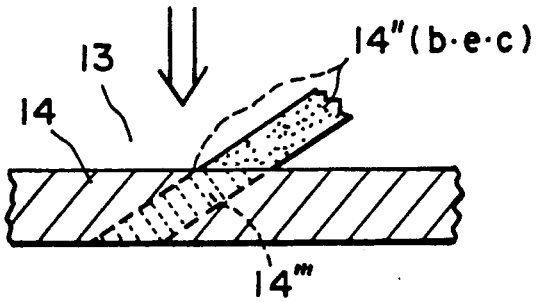

In the embodiment shown in FIG. 12A, the end 14''' of the branch path at the branching part may be disposed above the heat generating layer 14, it may be disposed below the heat generating layer 14 as shown in FIG. 12C, similar to the embodiment described hereinbefore.

Figure 13:
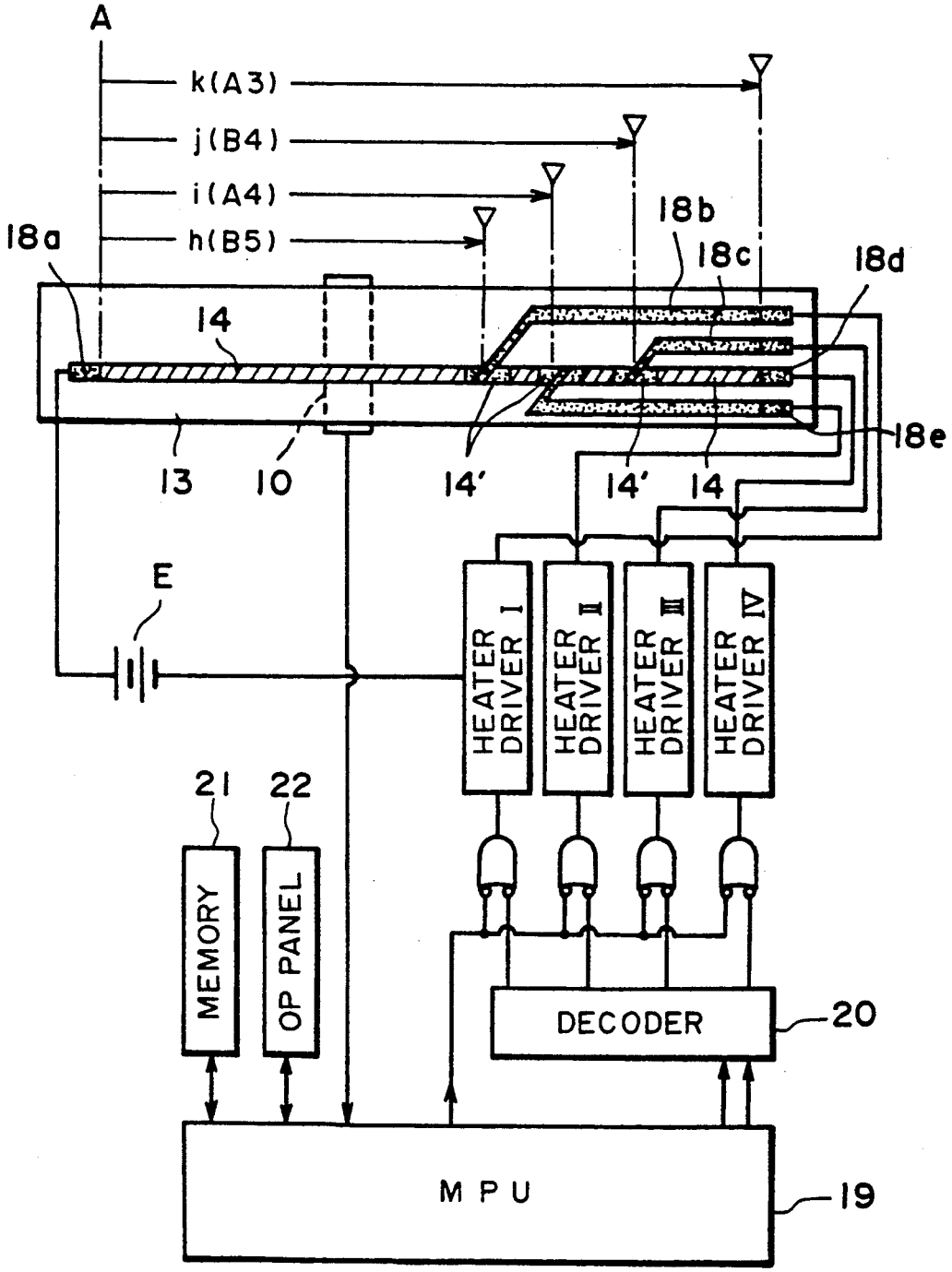
FIG. 13 is a block diagram of a heat control circuit used in another embodiment.

FIG. 13 shows a further embodiment, wherein parts 14' of the heat generating layer adjacent to the branch connection parts for the first-third branch paths 18*b*, 18*e* and 18*c*, have an electric resistance per unit area which is higher than the other portion of the heat generating layer 14. This is done by using different resistance materials to form the entire heat generating layer 14.

More particularly, the heat generating layer 14 is made of silver-palladium applied, and the portion 14' is made of ruthenium oxide applied. The ruthenium oxide of the portion 14' has a larger electric resistance per unit area than the silver-palladium of the portion 14. Therefore, when the heat generating layer 14 is supplied with electric power, the portion 14' produces a quantity of heat larger than that of the portion 14.

That is, at the portion 14', the heat escape attributable to the provision of the branch path is compensated, for so that the temperature decrease is further compensated for.

According to this embodiment, even when a larger size recording material such as A4, B4 or A3, which are sizes size larger than the small recording material (B5), is used, the image fixing performance does not decrease at the branch portions for the first - third branch path 18*b*, 18*e* and 18*c*.

In the foregoing, the two materials are silver-palladium and ruthenium oxide. However, the material are not limited to these, and various combinations of materials are possible. In addition, the same materials are usable, for example, the contents of silver-palladium may be changed to provide a higher resistance per unit area in the portion 14 than the portion 14'.

Figure 15:
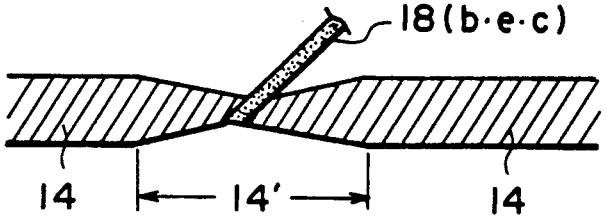
Figure 16:
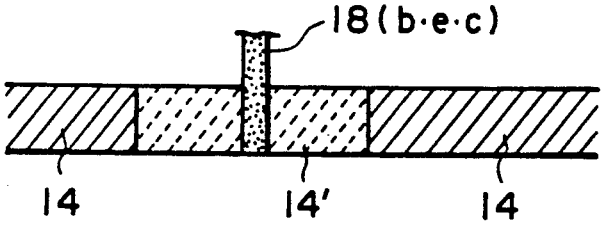

In a further example, the width of portion 14' may be gradually decreased from that of the portion 14, as shown in FIG. 15. By doing so, the portion 14' has a higher electric resistance than the portion 14, and therefore, the quantity of heat generation of the portion 14' is gradually increased.

Figure 14:
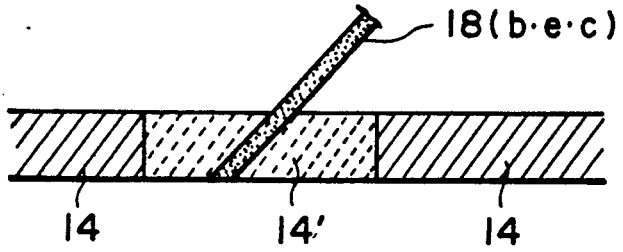
FIGS. 14–16 and 18 are partial enlarged views illustrating other embodiments of the present invention.

In this case, the necessity of applying two different resistance materials as in FIG. 14, is eliminated, and therefore, the manufacturing process can be simplified.

As a further method, the thickness of the heat generating layer may be changed. More particularly, the thickness of the portion 14' is made smaller than that of the heat generating layer 14 in FIG. 14, by which the resistance of the portion 14' at the branch can be made higher than that of the heat generating layer 14, so that the quantity of heat generation is increased thereat.

In each of the above cases, the electric resistance of the portion 14' can be so selected that the heat generating quantity of the portion 14' does not produce a substantial temperature ,difference from that of the portion 14 by compensating for the heat transfer attributable to the provision of the branch path.

By increasing the electric resistance of the heat generating layer adjacent the branch path to increase the quantity of heat generation, the temperature decrease at the branch can be prevented even if the branch path electrode is branched out in a direction substantially perpendicular to the heat generating layer.

Figure 17:
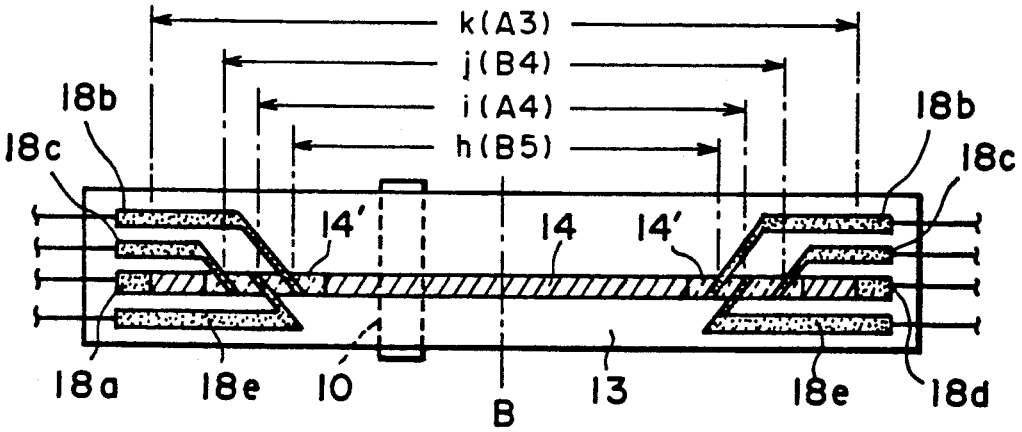
FIG. 17 is a top plan view of a heater according to a further embodiment.

FIG. 17 shows an embodiment of a branch path used with an apparatus wherein the recording material is conveyed with a central reference. The heat generating layer has the same structure as in FIG. 6 embodiment, except the branch portion. When the heat generating layer is branched to branch the electric current, it is possible that the temperature decreases at the branch with the result of lowered fixing power than the other part, even if the heat transfer attributable to the provision of the electrode is not eliminated.

This is because, the heat generating layer is virtually expanded at the branch portion, and therefore, the apparent resistance at the branch portion decreases, so that the quantity of heat generation decreases. FIG. 17 shows an embodiment wherein the temperature decrease at the branch is prevented in the apparatus wherein the electric current is branched at the non-passage portion.

Figure 18:
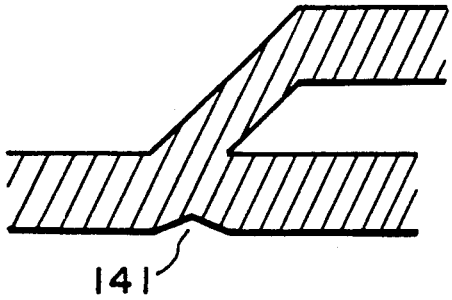

FIG. 18 is an enlarged top plan view at the branch. As will be understood from this figure, the heat generating layer has a cut-away portion 141 at each of the branch portions. When a large size, for example, A3 size sheet is used with such a heat generating layer, the voltage is applied between the electrodes 18*a* and 18*d*, by which a constant current I flows through the heat generating layer 13, and therefore, the quantity of generated heat ($I^2R$) is constant except for the branch portion, as long as the heat generating layer is uniform. On the other hand, at the branch, the heat generating layer is virtually expanded, and therefore, the amount of heat generation is smaller because of the smaller resistance. However, in this embodiment, the cut-away portion 16 is provided for the heat generating layer in each of the branch portions, and therefore, the expansion of the heat generating layer is compensated, for so that the resistance at the branch is equivalent to the other portion, and therefore, the quantity of heat generation is also equivalent. Therefore, when A3 sheet is passed, the temperature distribution of the heater is uniform including the branch portion, and therefore, the fixing performance is also uniform. When a smaller size sheet is passed, for example, a B5 size sheet is passed, the voltage is applied between the electrodes 18*a* and 18*b* and electrodes 18*b* and 18*d*. At this time, the current branches, and therefore, the quantity of heat generation becomes smaller at the branches, and therefore, the quantity of heat generation becomes smaller without overheating. Rather, the temperature becomes smaller than the sheet passage part. Therefore, the temperature decrease at the branch which is the boundary between the sheet passage part and the sheet non-passage part, can be compensated for.

Therefore, even if an end of B5 sheet passes by the boundary, no improper fixing does not occur.

Figure 19:
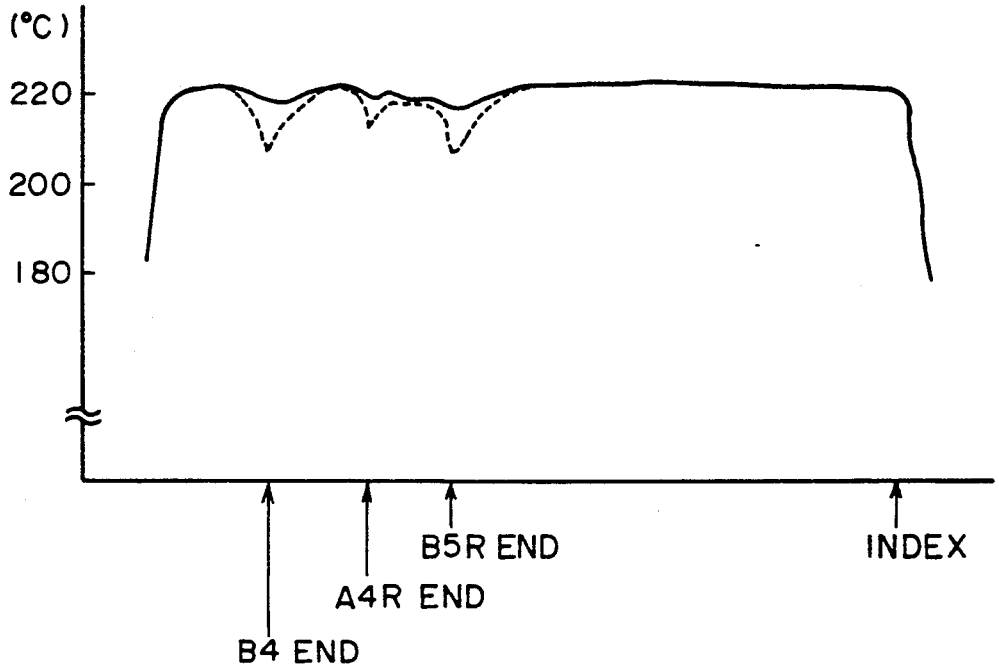
FIG. 19 is a graph showing the temperature distribution of the heater in a longitudinal direction.

A description will be provided as to the actual example. A heater having a width of 1.5 mm was formed on an alumina substrate having a width of 20 mm and a length of 340 mm in a pattern shown in FIG. 6. At the branches, the cut-away portion having a height of 0.1 mm was formed, as shown in FIG. 18. With such a pattern, the temperature of the heater surface was controlled at 220° C., and the temperature distribution was investigated. FIG. 19 shows the results of investigation, wherein the temperature difference between the branch portion and the portion therearound is 5° C. at maximum. Such a temperature difference does not produce any problem with the fixing performance.

In this figure, the broken line indicate the temperature distribution when the resistance of the heat generating layer at the branch is not made higher. As will be understood, the temperature decrease is approximately 15° C. at the branch portion.

As for the configuration of the cut-away portion, it is not limited to the configuration shown in FIG. 17, if the width of the heat generating layer is virtually decreased to increase the electric resistance.

Figure 20:
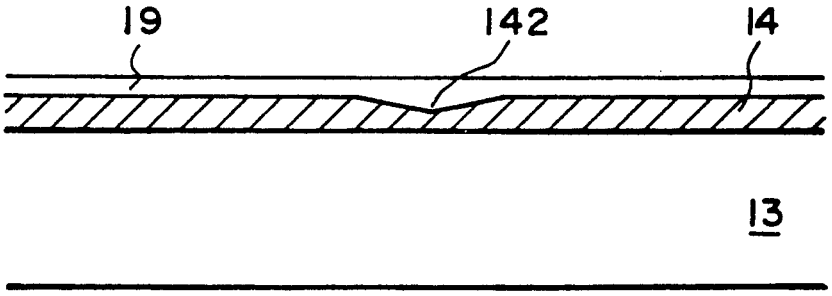
FIG. 20 is a partial sectional view illustrating a further embodiment.

FIG. 20 shows a further embodiment wherein in order to prevent the temperature decrease at the branch, the thickness of the resistor is reduced in place of decreasing the width of the resistor at the branch. FIG. 20 is an enlarged longitudinal view of the heater at one of the branches. The heat generating layer 14 is formed on the heater board 13, and the heat generating layer is coated with a protection film 19 made of glass or the like. The heat generating layer 14 is uniform in the direction of its width, and the thickness thereof is uniform in the direction of the width except for the branch portion. At the branch portion, a recess 142 is formed, so that the thickness is thinner than the other portion. With such a structure, similarly to the foregoing embodiment, the temperature distribution is uniform because the resistance layer is uniform, except for the branch portion, in the case of passage of a full size sheet. At the branch portion, the resistance layer is expanded in the direction of width, but because the thickness is reduced there, the resistance thereat is substantially equivalent to the other portion. Accordingly, the temperature decrease at the branch is not significant. In a similar manner to the foregoing embodiment, the fixing performance is substantially uniform along the length of the heat generating element.

In a similar manner to the embodiment of FIG. 14, the material of the heat generating member may be changed only at the neighborhood of the branch in the type wherein the current is branched at the non-passage portion.

The heat generating layer is formed by mixing various electric resistance materials such as silver-palladium, and the resistance may be easily changed by changing the content thereof. Therefore, the material at the branch is so selected that the electric resistance thereof becomes higher. The investigation made by the inventors have revealed that by increasing the electric resistance at the branch portion by several percent, the temperature distribution is made practically uniform.

In all of the foregoing embodiments, the quantities of heat generation in the sheet passage part is increased by branching the electric path, but the increase is not a problem, because the temperature in the passage part is controlled in response to the temperature detected by the thermister.

While the invention has been described with reference to the structures disclosed herein, it is not confined to the details set forth and this application is intended to cover such modifications or changes as may come within the purposes of the improvements or the scope of the following claims.

What is claimed is:

1. An image fixing apparatus, comprising:

a heater; and a movable film in contact with said heater at one side thereof and in contact with a recording material at the other side thereof, wherein a visualized image on the recording material is heated and fixed by heat from said heater through said film, said heater including:

a heat generating layer extending in a direction crossing a movement direction of said film, for producing heat by application of a voltage between its longitudinal opposite ends; and an electric path branching out of an image fixing part of said heat generating layer in a direction parallel to said heat generating layer, wherein an electric current flowing through said heater is divided into the branching electric path and said heat generating layer; and selecting means for selecting the electric path in accordance with a size of the recording material.

2. An apparatus according to claim 1, wherein a position where the electric path is branched out substantially corresponds to a lateral end of the recording material, and wherein the electric current is divided at a position corresponding to a recording material non-passage part of said heat generating layer.

3. An apparatus according to claim 2, wherein the quantity of heat generated per unit length by said heater is smaller in the non-passage part than in a recording material passing part.

4. An apparatus according to claim 1, wherein said selecting means selects the electric path so as not to divide the current upon image fixing on the recording material having a maximum usable size.

5. An apparatus according to claim 1, wherein the recording material is fed with its lateral side aligned with a reference, and wherein the electric path is provided adjacent a lateral side opposite from the reference.

6. An apparatus according to claim 1, wherein the recording material is fed with its center aligned with a central reference, and wherein the electric path is provided adjacent each of the lateral sides of the reference material.

7. An apparatus according to claim 1, further comprising a pressing member for pressing the recording material to said film toward said heater.

8. An apparatus according to claim 1, wherein said film is in the form of an endless belt.

9. An apparatus according to claim 1, wherein the visualized image is made of powdery toner.

10. An image fixing apparatus, comprising:

a heater;

a film movable together with a recording material in contact with said heater at one side thereof and in contact with the recording material at the other side thereof, wherein a visualized image on the recording material is heated and fixed by heat from said heater through said film, wherein said heater includes a heat generating element extending in a direction crossing a movement direction of said film, for producing heat upon the supply of electric power thereto; and control means for controlling the electric power supply to said heater in accordance with the size of the recording material, wherein said heater generates heat in response to control by said control means in a recording material passage part and in a recording material non-passage part and generates heat at a smaller heat generating rate per unit length in a recording material non-passage part than in a recording material passage part.

11. An apparatus according to claim 10, wherein said heat generating element has plural electric power supply contacts provided at least at one side thereof, and wherein said control means selects at least one of the contacts.

12. An apparatus according to claim 11, wherein the recording material is fed with its lateral end aligned with a reference, wherein one of said contacts is provided at a side of the reference, and wherein a plurality of said contacts are provided at an opposite side of said heater.

13. An apparatus according to claim 11, wherein the recording material is fed with its center aligned with a central reference, and wherein plurality of are provided adjacent each of the opposite ends of said heater.

14. An apparatus according to claim 10, further comprising a pressing member for pressing the recording material to said film toward said heater.

15. An apparatus according to claim 10, wherein said film is in the form of an endless belt.

16. An apparatus according to claim 10, wherein said visualized image is made of powdery toner.

17. An image fixing apparatus, comprising:

a heater; and a film movable together with a recording material in contact with said heater data one side thereof and in contact with the recording medium at the other side thereof, wherein a visualized image on the recording material is heated and fixed by heat from said heater through said film, said heater including a heat generating layer extending in a direction crossing with the movement direction of said film, for producing heat by the application of a voltage between opposite ends thereof, wherein said heat generating layer has at least one electric path branched from said heat generating layer, and wherein said electric branched path is inclined at a branch portion in a direction crossing the film movement direction.

18. An apparatus according to claim 17, further comprising selecting means for selecting the electric branch path in accordance with a size of the recording material.

19. An apparatus according to claim 18, wherein the electric branch path substantially corresponds to a lateral end of the recording material, and wherein electric current is branched by the electric branch path in a recording material non-passage part of said apparatus.

20. An apparatus according to claim 19, wherein said selecting means selects an electric branch path so as not to divide the current upon image fixing on the recording material having a maximum usable size.

21. An apparatus according to claim 18, when said selecting means selects an electric branch path, substantially only a recording material passage part of said heat generating layer generates the heat.

22. An apparatus according to claim 17, further comprising a pressing member for pressing the recording material to said film toward said heater.

23. An apparatus according to claim 17, wherein said film is in the form of an endless belt.

24. An apparatus according to claim 17, wherein said visualized image is made of powdery toner.

25. An image fixing apparatus, comprising:

a heater; and a film movable together with a recording material in contact with said heater at its one side thereof and in contact with the recording material at the other side thereof, wherein a visualized image on the recording material is heated and fixed by heat from said heater through said film;

said heater including a heat generating layer extending in a direction crossing with a movement direction of said film, for generating heat by the application of voltage between opposite longitudinal ends thereof, said heat generating layer including a branch path, wherein a portion of said heat generating layer where the branch path is branched has a resistance which is larger than that of another portion thereof.

26. An apparatus according to claim 25, wherein the branch path of said heat generating layer is made of a material having a larger resistance than the another portion of said heat generating layer.

27. An apparatus according to claim 25, wherein the branch path of said heat generating layer has a width smaller than the another portion.

28. An apparatus according to claim 25, wherein the branch path of said heat generating layer has a thickness which is smaller than the another portion.

29. An apparatus according to claim 25, wherein the branch path substantially corresponds a lateral end of the recording material, said apparatus further comprising selecting means for selecting the branch path in accordance with a size of the recording material.

30. An apparatus according to claim 29, wherein electric current is branched by said branch path in a recording material non-passage part.

31. An apparatus according to claim 30, wherein said selecting means selects the branch path so as not to branch the current when a maximum usable size recording material is used.

32. An apparatus according to claim 29, wherein substantially only a part of said heat generating layer corresponding to a recording material passage part generates heat, by said selecting means selecting the branch path.

33. An apparatus according to claim 25, further comprising a pressing member for pressing the recording material to said film toward said heater.

34. An apparatus according to claim 25, wherein said film is in the form of an endless belt.

35. An apparatus according to claim 25, wherein said visualized image is made of powdery toner.

* * * * *

UNITED STATES PATENT AND TRADEMARK OFFICE

CERTIFICATE OF CORRECTION

PATENT NO. 5,171,969

DATED December 15, 1992

INVENTOR(S) NISHIMURA et al.

It is certified that error appears in the above-indentified patent and that said Letters Patent is hereby corrected as shown below:

COLUMN 1

Line 67, "reduction of" should be deleted.

COLUMN 2

Line 1, "the" should read --there is--.

COLUMN 3

Line 58, "case" should read --case that--.

COLUMN 4

Line 54, "passengers" should read --passage--.

COLUMN 5

Line 60, "cressing," should read --creasing,--.

COLUMN 6

Line 23, "roughness. Since" should read --roughness, since--.

UNITED STATES PATENT AND TRADEMARK OFFICE

CERTIFICATE OF CORRECTION

PATENT NO. 5,171,969

DATED December 15, 1992

INVENTOR(S) NISHIMURA et al.

It is certified that error appears in the above-indentified patent and that said Letters Patent is hereby corrected as shown below:

COLUMN 7

Line 6, "the" should be deleted.

COLUMN 8

Line 29, "a" should read --are--.

Line 56, "a" should read --one--.

COLUMN 10

Line 4, "inclined" should read --inclining--.

Line 37, "compensated, for" should read --compensated for,--.

Line 42, "size" should be deleted.

COLUMN 11

Line 47, "compensated, for" should read --compensated for,--.

Line 66, "no" should be deleted.

UNITED STATES PATENT AND TRADEMARK OFFICE

CERTIFICATE OF CORRECTION

PATENT NO. 5,171,969

DATED December 15, 1992

INVENTOR(S) NISHIMURA et al.

It is certified that error appears in the above-indentified patent and that said Letters Patent is hereby corrected as shown below:

COLUMN 14

Line 23, "wherein plurality" should read --wherein the plurality of contacts--.

Line 35, "data" should read --at--.

COLUMN 15

Line 14, "with" should be deleted.

Signed and Sealed this

Twenty-fifth Day of January, 1994

Bruce Lehman

*Attest:*

BRUCE LEHMAN

*Attesting Officer*

*Commissioner of Patents and Trademarks*